US008985981B2

(12) United States Patent
Fromm et al.

(10) Patent No.: US 8,985,981 B2
(45) Date of Patent: Mar. 24, 2015

(54) ROTARY DISPLACEMENT PUMP FOR PUMPING SOLIDS EMULSIONS, ESPECIALLY LIQUID EXPLOSIVES

(75) Inventors: Ulrich Fromm, Ilsfeld (DE); Sven-Eric Will, Ilsfeld (DE)

(73) Assignee: Watson Marlow GmbH, Ilsfeld (DE)

( * ) Notice: Subject to any disclaimer, the term of this patent is extended or adjusted under 35 U.S.C. 154(b) by 222 days.

(21) Appl. No.: 13/823,772

(22) PCT Filed: Sep. 15, 2010

(86) PCT No.: PCT/EP2010/063572

§ 371 (c)(1),
(2), (4) Date: Apr. 17, 2013

(87) PCT Pub. No.: WO2012/034592

PCT Pub. Date: Mar. 22, 2012

(65) Prior Publication Data

US 2013/0209243 A1 Aug. 15, 2013

(51) Int. Cl.
*F04C 18/00* (2006.01)
*F04C 15/00* (2006.01)
(Continued)

(52) U.S. Cl.
CPC ..... *F01D 9/00* (2013.01); *F04C 2/3568* (2013.01); *F04C 13/001* (2013.01); *F04C 14/28* (2013.01); *F04C 15/0038* (2013.01); *F04C 2210/44* (2013.01)
USPC ..... 418/216; 418/219; 418/130; 418/139; 418/149

(58) Field of Classification Search
CPC ..... F04C 2/356–2/3568; F04C 2240/10; F04C 2250/30; F04D 5/008
USPC ..... 418/125, 127, 129, 130, 133, 134, 149, 418/215–219, 221–223, 228, 229, 243, 244, 418/260; 415/182.1–191; 207/402, 549
See application file for complete search history.

(56) References Cited

U.S. PATENT DOCUMENTS 1,690,728 A * 11/1928 Jaworowski ..... 418/216
3,156,158 A * 11/1964 Pamplin ..... 418/217
(Continued)

FOREIGN PATENT DOCUMENTS

DE 42 18 385 11/1993
DE 20 2004 000188 4/2004
(Continued)

OTHER PUBLICATIONS

International Preliminary Report on Patentability for corresponding PCT/EP2010/063572, dated Nov. 30, 2012, pp. 1-6.
(Continued)

*Primary Examiner* — Thomas Denion
*Assistant Examiner* — Laert Dounis
(74) *Attorney, Agent, or Firm* — Brinks Gilson & Lione

(57) ABSTRACT

A rotary displacement pump of an undulatory disk type; with a pump housing (24) comprising a front end plate (56) and a rear end plate, the pump housing enclosing a stator (40, 48), a rotor (42), a scraper (44) and a scraper guide (46), a shaft (8) extending through at least the rear end plate; the stator including a generally semi-circular arc-formed first stator member (40) and a generally semi-circular arc-formed second stator member (48), the stator, the pump housing and the scraper together with the scraper guide defining an inlet and outlet chamber, wherein at least part of the end faces of the first and second stator members being situated in the outlet chamber are oblique so as to provide an obtuse-angled transition to the inner faces of the front end plate and the rear end plate.

21 Claims, 5 Drawing Sheets

(51) Int. Cl.

| | |
|---|---|
| ***F01D 9/00*** | (2006.01) |
| ***F04C 2/356*** | (2006.01) |
| ***F04C 13/00*** | (2006.01) |
| ***F04C 14/28*** | (2006.01) |

(56) References Cited

U.S. PATENT DOCUMENTS

| | | | | |
|---|---|---|---|---|
| 3,195,412 | A * | 7/1965 | Phillips | 409/167 |
| 3,994,638 | A * | 11/1976 | Garland et al. | 418/216 |
| 4,093,408 | A * | 6/1978 | Yamaguchi | 418/92 |
| 4,575,324 | A * | 3/1986 | Sommer et al. | 418/217 |
| 5,980,225 | A * | 11/1999 | Sommer | 418/104 |
| 6,773,244 | B2 * | 8/2004 | Lee et al. | 418/216 |
| 6,893,241 | B2 * | 5/2005 | Yang | 418/216 |
| 7,462,022 | B2 * | 12/2008 | Fromm | 418/216 |
| 8,403,656 | B2 * | 3/2013 | Fromm | 418/216 |

FOREIGN PATENT DOCUMENTS

| | | |
|---|---|---|
| FR | 1 443 614 | 6/1966 |
| GB | 2 085 081 | 4/1982 |
| WO | WO 2005/066496 | 7/2005 |

OTHER PUBLICATIONS

International Search Report for corresponding PCTEP2010/063572, dated Jun. 24, 2011, pp. 1-3.

* cited by examiner

ROTARY DISPLACEMENT PUMP FOR PUMPING SOLIDS EMULSIONS, ESPECIALLY LIQUID EXPLOSIVES

CROSS-REFERENCE TO RELATED APPLICATIONS

The present application claims the benefit under 35 U.S.C. §371 of International Patent Application No. PCT/EP2010/063572, having an international filing date of Sep. 15, 2010, the content of which is incorporated herein by reference in its entirety.

FIELD

The present invention relates to a rotary displacement pump for pumping solids emulsions, especially liquid explosives.

BACKGROUND

From the EP 1 807 624 B1, a rotary displacement pump is known which allows for pumping flowable, relatively viscose materials in the food stuff industry, the chemical and biochemical industry, the medical industry and the cosmetic industry. Examples of materials that can be pumped by such rotary displacement pump are yoghurt, soup, sauce, mayonnaise, fruit juice, cheese material, chocolate, paint, cosmetic cream, and lipstick material.

Now there is a need for pumping solids emulsions, especially liquid explosives. Such liquid explosives are for example used in the mining industry in the field of tunneling and operation of quarry where such liquid explosives have to be pumped in cavities and channels in the rocks where they are ignited to explode in a controlled fashion.

The rotary displacement pump disclosed in the EP 1 807 624 B1 is not suitable for pumping such solids emulsions. When pumping such solids emulsions with the displacement rotary pump, the solids emulsions collect, build up and pack in certain regions of the pump which increases the friction, builds up additional pressure and heats up the pump. This results in a loss of efficiency or even a total outage of the pump. When pumping liquid explosives comprising small spherical components also referred to as prill it is this prill that collects, builts up and packs in many places of that pump, which in addition to the drawbacks as mentioned above, is dangerous to men and environment. In the worst case, the whole rotary displacement pump can explode, when the temperature within the pump rises above a critical point.

Currently, the pumps used for pumping such solids emulsions and liquid explosives are of bigger size and more complex design which makes their use in connection with solids emulsions and liquid explosives inconvenient and expensive and which limits the applications to situations where enough space is available for such bigger pumps.

SUMMARY

It is therefore an object of the invention to provide a rotary displacement pump of the "protruding web of rotor engaging in an engagement slot of scraper"-type allowing for a small pump size and being capable of pumping solids emulsions especially liquid explosives in an efficient and safe manner.

This object is attained by a rotary displacement pump for pumping solids emulsions, especially liquid explosives as defined in claim 1.

Such rotary displacement pumps comprises a stator; a rotor configured to be driven by a shaft, the rotor including a shaft portion and a radially protruding web having a configuration of an undulatory disk type; a scraper having an engagement slot of predetermined radial height and predetermined axial width, the engagement slot engaging the protruding web of the rotor; the scraper being supported by a scraper guide so as to be retained in circumferential direction and to allow a reciprocating movement in a substantially axial direction; a pump housing comprising a front end plate and a rear end plate, the pump housing enclosing the stator, the rotor, the scraper and the scraper guide; the shaft extending through at least the rear end plate; the stator including a generally semi-circular arc-formed first stator member and a generally semi-circular arc-formed second stator member, the first and second stator members abutting to each other laterally along a radially outer abutment portion so as to form a stator channel through which the radially protruding web of the rotor runs and to define an enclosure that encircles a generally semi-circular arc-formed portion of the radially protruding web of the rotor; the stator, the pump housing and the scraper together with the scraper guide defining an inlet chamber and an outlet chamber, the scraper together with the scraper guide forming a partition between the inlet chamber and the outlet chamber, the inlet and outlet chambers being provided with respective inlet and outlet ports; the stator channel extending from the inlet chamber to the outlet chamber, the web of the rotor being rotatable through the inlet chamber, the stator channel, the outlet chamber and the slot of the scraper, wherein at least part of the end faces of the first and second stator members being situated in the outlet chamber are oblique so as to provide an obtuse-angled transition to the inner faces of the front end plate and the rear end plate.

With such a rotary displacement pump, solids emulsions, and especially liquid explosives can be pumped efficiently and safely. By the obtuse-angled transition of at least part of the end faces of the first and second stator members to the inner faces of the front and rear end plates, the material build up, and especially the prill build up along edges and in grooves is minimized, thereby providing for an efficient and safe operation of the rotary displacement pump when pumping solids emulsions and especially liquid explosives. It has been discovered by the inventors that it is mostly the prill that builds up and packs within the pump housing and in particular within the outlet chamber, and such prill, in addition to packing the pump housing and in particular the outlet chamber, has a disadvantageous abrasive effect.

The inventors of the present rotary displacement pump have made countless different modifications to different features of rotary displacement pumps until finding out that by the rotary displacement pump, as defined in claim 1, an efficient and safe pumping of solids emulsions, and especially liquid explosives can be attained.

By the outlet chamber which is confined by the end faces of the first and second stator members providing an obtuse-angle transition to the inner faces of the front and rear end plates, by the pump housing, by the scraper and the scraper guide, the material built up and the packing of material can be significantly reduced which provides for improved material flow characteristics and, consequently, for an efficient and safe operation.

According to a first embodiment of the invention, the obtuse-angle between the end faces of the first and second stator members and the inner faces of the front end plate and the rear end plate is 120 to 160°, particularly 140 to 160°. These angles have been proven to provide for a particularly good and smooth material flow.

According to a further embodiment of the invention the shaft extends through both the front and rear end plates, which are provided with central openings for this purpose, and generally tube-shaped front and rear seal housing elements are provided being positioned in the recesses of the first and second stator elements.

These housing elements are stationary and encircle the rotating shaft/shaft sleeve elements.

According to a further embodiment of the invention, these seal housing elements confine the inlet and outlet chambers in a direction towards the shaft therefore provide part of the boundary of the inlet and outlet chambers.

According to a further embodiment of the invention, the seal housing elements are provided with at least one slot in order to reduce the pressure within the inlet and outlet chambers and in order to relieve material build up. The pumped solids emulsions will get through such slot into the interspace between the seal housing elements and the shaft/shaft sleeve elements, and material built up above the seal housing elements can be minimized.

According to a further embodiment of the invention, front and rear shaft sleeves attach to the rotor, wherein the front and rear shaft sleeves are situated within the seal housing elements, and wherein sealing elements are provided between the rotating front and rear shaft sleeves and the stationary seal housing elements.

Such sealing elements provide for a sealing between the rotating front and rear shaft sleeves and the stationary seal housing elements. However, these sealing elements are not totally tight, but allow for a pressure compensation, and a certain amount of the pumped solids emulsions can pass through the sealing elements in a forward direction out of the front end plate and in a rearward direction out of the rear end plate and can leave the pump housing that way.

According to a very compact embodiment of the invention, the sealing elements are provided at the inner side of the seal housing elements.

According to a further embodiment of the invention, the sealing elements are formed as three lip sealing rings with two interposed support rings. The two sealing rings that are situated closest to the rotor provide for a sealing to the outside, and the outermost sealing ring provides for a sealing from outside to inside.

According to a further embodiment of the invention, the generally tube-shaped front seal housing element and the generally tube-shaped rear housing element are of identical shape and size.

According to a further embodiment of the invention, the front and rear shaft sleeves are also of identical shape and size.

By mirroring the design of the front and rear housing elements and, preferably, also of the front and rear shaft sleeves a part commonality is attained which helps to save costs and provides a means of pressure relief at both ends of the shaft.

According to a further embodiment of the invention, the tip of the shaft or the front shaft sleeve and/or a front locking element that secures the front shaft sleeve to the shaft protrudes out of that front end plate, which is provided with a central opening.

It has been discovered by the inventors, that by such embodiment material built up is further mitigated and a pressure relief through the front sealing element in a forward direction can be attained. It has further been discovered that by such embodiment the drawback of a material build up and packing of material between a bushing assembly and the cover which happened when the front cover end of the shaft was closed and supported by a bushing can reliably be avoided. According to a further effect of this embodiment a certain degree of load support is achieved in addition.

According to a further embodiment of the invention, a security cover element is provided covering the tip of the shaft or the front shaft sleeve and/or the front locking element, wherein this security cover element has evacuation apertures, particularly radially oriented evacuation apertures in order to allow for the solids emulsions to pass through. By the provision of such security cover element injuries caused by the rotating shaft tip can be avoided. The solids emulsion can pass through the evacuation apertures which further helps avoiding material built up in the inside of the pump housing.

According to a further embodiment of the invention a recessed spacer element having evacuation apertures, in particular radially-oriented evacuation apertures, is provided behind the rear end plate. The evacuation apertures allow for the solids emulsion passing through which further mitigates material build up and provides for an additional pressure relief through the rear sealing element in a rearward direction.

According to a further embodiment of the invention, the evacuation apertures are closed by means of grating elements, in particular by means of a grating security ring. Thereby a discharge of solids emulsion can be attained, wherein at the same time injuries by people unintentionally putting their fingers through the apertures and touching the rotating shaft or shaft sleeves can be avoided.

According to a further embodiment of the invention, the scraper has the general form of a plate, particularly a rectangular plate, with the engagement slot formed therein. Furthermore, the width of the scraper can correspond to 65 to 75%, particularly to 68 to 72% of the width of the inlet and outlet chambers, measured from the front end plate to the rear end plate of the pump housing, so as to provide, in the extreme axial positions of the scraper, for sufficient distance between the side faces of the scraper and the front and rear end plates of the pump housing.

The inventors have found that by a scraper of such reduced width material built up in particular in between the side faces of the scraper and the front and rear end plates of the pump housing, in corner areas as well as in mating cavities in the pump housing can be significantly reduced which contributes to a safe and efficient operation of the pump.

According to a further embodiment of the invention, the scraper has the general form of plate, particularly a rectangular plate, with the engagement slot formed therein. The side faces of the scraper can be oblique with respect to an axial plane, with the rear face of the scraper oriented towards the outlet chamber having a smaller surface area than the front face of the scraper oriented towards the inlet chamber. By this feature the effect of packing solids emulsions, in particular into the space between the side faces of the scraper and the facing portions of the front and rear end plates of the pump housing, into corner areas of the outlet chamber and into mating cavities in the pump housing can be considerably reduced. This embodiment further contributes to a safe and efficient operation of the pump.

According to a further embodiment of the invention, the angle between the side faces of the scraper and the axial plane is in the range of 20 to 60 degrees, particularly in the range of 30 to 40 degrees. These angles have been found to be particularly advantageous.

According to a further embodiment of the invention, the scraper guide has a form of a recessed plate or cartridge, with the width of the recess being such that the engagement slot of the scraper in its extreme axial positions lies within this recess, thereby providing a compact and reliable construction of the scraper and scraper guide.

According to a further embodiment of the invention, the scraper guide can be provided with limit stops defining the extreme axial positions of the scraper. By the provision of such limit stops the limits of the movement of the scraper can be defined precisely therefore preventing misfunction.

According to a further embodiment of the invention, the scraper guide is supported within the pump housing between the front end and rear end plates. For this purpose at least one of the front and rear end plates can be provided with a mating cavity in order to support the scraper guide. By these features the scraper guide can be maintained in its optimum position reliably and permanently.

According to a further embodiment of the invention, the scraper has a radially outer guiding groove that engages with a corresponding guiding track of the scraper guide and a radially inner guiding groove engaging with corresponding circumferential portions of the seal housing elements. Thus, the scraper can be retained in a circumferential direction and allows for a reciprocating movement in a substantially axial direction. This configuration is particularly compact and stable and only requires a minimum number of parts involved.

According to a further embodiment of the invention, the material of the scraper is chosen with a melting temperature below the critical temperature of the pumped product. If the temperature within the pump housing rises due to dead heading, dry running, mechanical binding or another cause, the engagement slot in the scraper that mates with the rotor will deform and enlarge, thus reducing friction and preventing additional pressure and heat built up. This embodiment contributes for further safety of the pump operation.

The present invention also relates to the use of a pump, as described and defined above, for pumping solids emulsions of any kind and in particular for pumping liquid explosives. As described above, the inventors have found out that by a pump having a design as defined in the appended claims, such difficult and dangerous materials can be pumped safely and efficiently.

The invention will now be described in greater detail referring to the embodiments described in the following and shown in the accompanying drawings.

DETAILED DESCRIPTION

Figure 1:
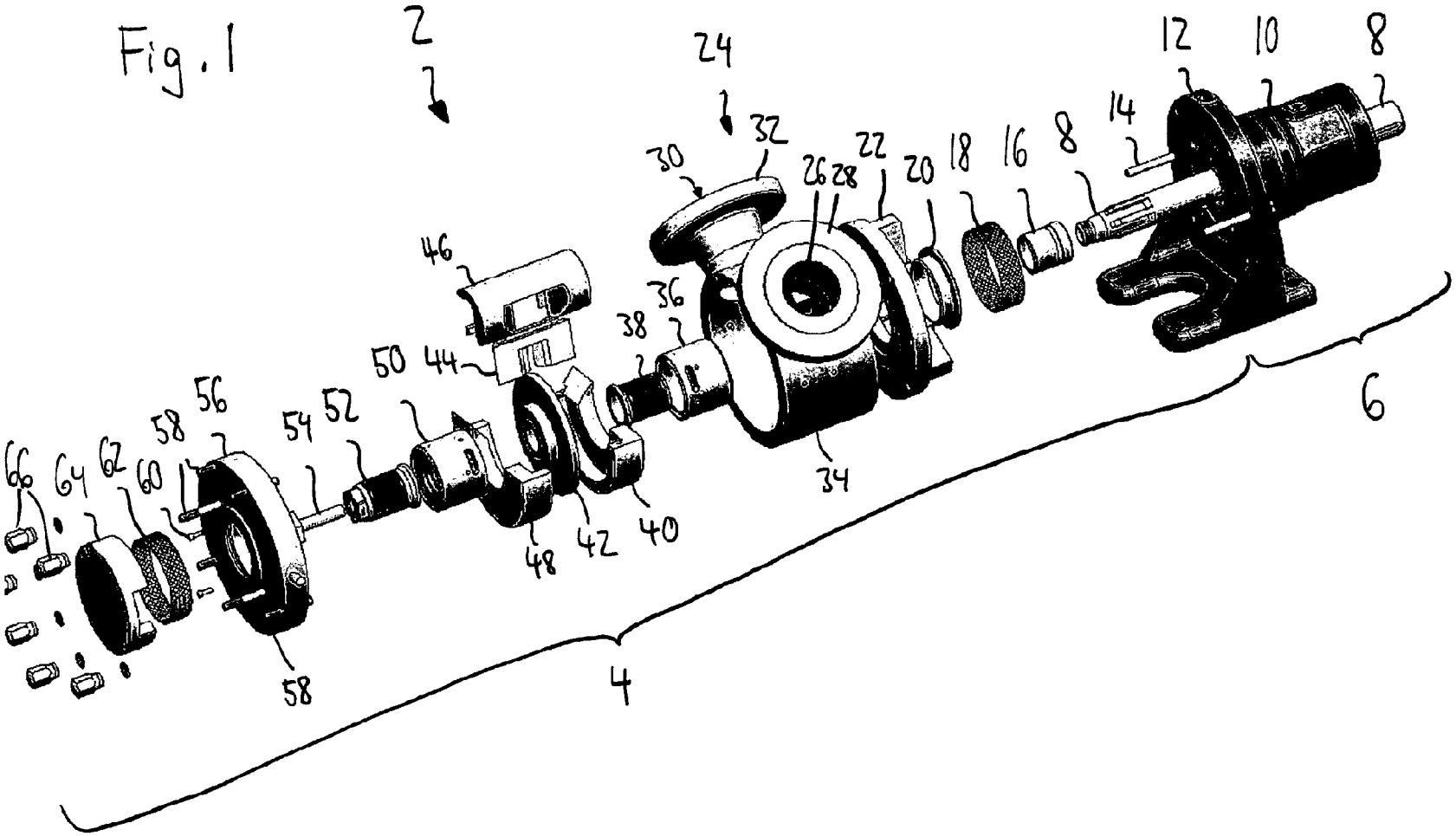
FIG. 1 shows an exploded view of a rotary displacement pump according to an embodiment of the invention showing the parts involved.

The terms "front" and "back/rear" are to be understood in the forthcoming figures with respect to the axis of the shaft 8, the terms "left" and "right" are to be under-stood in the forthcoming figures with respect to the axis of the shaft 8, when seen from the back (substantially right-hand in FIG. 1) to the front (substantially left-hand in FIG. 1) of the shaft 8, such that the parts of the pump that lie, with respect to the shaft 8, on the closer side to the viewer in FIG. 1 are positioned "left" and the parts of the pump that lie, with respect to the shaft 8, on the farther side from the viewer in FIG. 1 are positioned "right".

FIG. 1 shows an entire rotary displacement pump 2 comprising a pump part 4 or pump proper 4 and a support part 6.

At the right-hand side of FIG. 1, an end portion of a shaft 8 protrudes from the support part 6. A drive motor, not shown, typically an electric motor serves to apply torque to the shaft 8, either by being directly or through a coupling coupled to the shaft 8 or for example through a gear or a pulley etc. The support part 6 comprises a support part housing 10 in which appropriate roller bearings (not shown) for the shaft 8 can be provided.

The support part housing 10 has a substantially cylindrical shape, and the front end of the support part housing 10 is encircled and fixed by a mounting frame 12 that has a lower mounting plate in order to fix the entire rotary displacement pump 2 to an appropriate base. At the left and right sides of the frame part of the mounting frame 12 there are provided mounting pins 14 protruding out of the front side of the mounting frame 12 in a forward direction in order to engage with corresponding holes in the spacer ring 22 and the tubular cylindrical body 34 (to be described in further detail later) and to join the support part 6 and the pump part 4 firmly together. The middle to front portion of the shaft 8 is provided with axially extending recesses that engage with corresponding protrusions of the disk member 42 (described in further detail later), and, if appropriate, with other rotating parts of the pump part 4. The tip of the shaft 8 is tapering.

A disk member 42 is keyed to the shaft 8 and rotates with the shaft 8. In the following, the disk member 42 will be referred to as "disk 42". The shaft 8 and disk 42 are part of a rotor. The disk 42 comprises a radially protruding web having an axial thickness and predetermined outer diameter. The web has a rear surface and a front surface. If one follows, for example with a fingertip the front surface, along the circle line of the outer diameter, the fingertip will describe a curved sinus-type line seen in radial view (not necessarily in the strict mathematical sense), undulating with respect to a middle plane intersecting the axis of the shaft 8 at a right angle. Along a 360° circle there are two full periods of the sine curve, i.e. the first time from completely left-hand in FIG. 1 to completely right-hand in FIG. 1 and back. The same description as made with respect to the front face applies to the rear face as well. For simplicity, this undulating form of the web of the disk 42 is not depicted in the figures.

The pump proper 4, in the following referred to simply as "pump 4", comprises a pump housing 24 having the following the main parts: a tubular cylindrical body 34 provided at its rear end with a circular, rear end plate (not visible in FIG. 1), a circular front end plate 56, an inlet pipe socket/inlet port 26 provided with an inlet port flange 28, and an outlet pipe socket/outlet port 30 provided with an outlet port flange 32. The inlet and outlet ports 26, 30 are welded to the tubular cylindrical body 34.

The axis of the inlet and outlet ports 26 and 30 intersect at 90°. Accordingly, the tubular cylindrical body 34 has two openings corresponding to the diameter of the inlet and outlet ports 26 and 30.

The body 22, the end plates and the inlet and outlet ports 26, 30 consist of stainless steel.

A stator lines the lower half of the inside of the housing 24. The stator consists of a generally semi-circular arc-formed rear stator member 40 and of a generally semi-circular arc-formed front stator member 48, that can be formed separately as in the FIG. 1, or integrally with the front end plate and, respectively the rear end plate. The stator elements can be formed as liner elements fixed in the pump housing 24. They can be made of plastics material, particularly polyamide.

Figure 2:
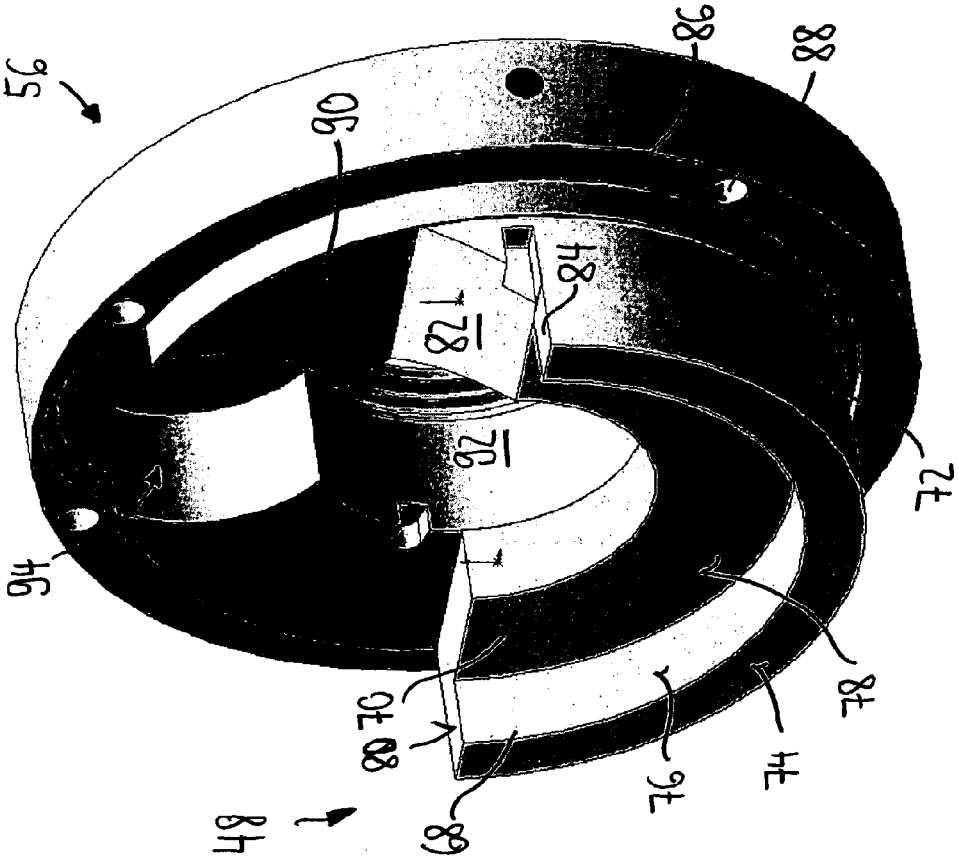
FIG. 2 shows a perspective view of a front cover provided with a front stator/liner element of the rotary displacement pump of FIG. 1, according to an embodiment of the invention.

Taking reference to FIG. 2, the front stator member 48 abuts with its outer surface (the term outer is to be understood with respect to the disk 42) against the ring-formed inner face 90 of the front end plate 56. In a radial sectional cut, the front stator member 48 has the profile of an "L"/a reversed "L" with the radially oriented portion of the profile forming an radial wall 70 for the web 42 and with the axially-oriented portion of the profile forming a circumferential wall 68 for the web 42. Accordingly, the inner end (the term "inner" is to be understood opposite to the term "outer", see above) of the circumferential wall 68 forms a lateral abutment face 74 that abuts in the mounted state to the opposite lateral abutment face of the rear stator member 40.

The face of the circumferential wall 68 that is oriented towards the shaft axis forms a stator channel bottom face 76 and the inner face of the radial wall 70 forms a lateral stator channel face 78.

Appropriate sealing means sealing the outer face 72 of the front stator element 48 to the lower half of the inside of the tubular cylindrical body 34 can be provided (not shown).

Following a central opening 92 of the rear end plate 56 there is a recess provided in the front stator element 48 so that the shaft 8 can extend through both the central opening 92 and the central recess.

The upper left end face of the generally semi-circular arc 48, which is designated with reference numeral 80 in FIG. 2, is straight and extends horizontally. It forms the inlet chamber bottom 80.

The upper right end face of the generally semi-circular arc 48, comprises a straight, horizontal end face of the circumferential wall 68 forming a straight outlet chamber bottom part 84 and a oblique end face of the radial wall 70 forming an oblique transition portion 82 of the outlet chamber to the ring-formed inner face 90 of the front end plate 56.

The same description as made with respect to the front stator element 48 applies in an analogous manner to the rear stator element 40. Generally speaking, the rear stator member 40 is a mirror-image to the front stator member 48, and the rear stator member 40 butts with its outer surface to the ring-formed inner surface of the rear end plate of the pump housing 24.

Taking reference to FIG. 1 again, there are provided, in the upper part of the inside of the pump housing 24, an inlet chamber adjacent to the inlet port 26 and an outlet chamber adjacent to the outlet port 30. The inlet chamber is provided in the upper left quadrant of the inside of the pump housing 24 that is located closer to the viewer of FIG. 1 and the outlet chamber is provided in the upper right quadrant of the inside of the pump housing 24 that is located farther from the viewer of FIG. 1.

When the parts of the pump proper 4 are assembled, the inlet chamber is confined by the inlet chamber bottoms 80 of the stator elements 40 and 48, by the parts of the front and rear seal housings 50 and 36 lying in the upper left quadrant of the inside of the pump housing 24, by the left sides of the scraper 44 and the scraper guide 46 and by the inner face of the upper left quadrant of the tubular cylindrical body 34.

Likewise, when the parts of the pump proper 4 are assembled, the outlet chamber is confined by the straight outlet chamber bottoms 84 and the oblique transition portions 82 of the stator elements 40 and 48, by the parts of the front and rear seal housings 50 and 36 lying in the upper right quadrant of the inside of the pump housing 24, by the right sides of the scraper 44 and the scraper guide 46 and by the inner face of the upper right quadrant of the tubular cylindrical body 34.

The hub of the disk 42 is clamped by means of a locking screw 54 in axial direction against the rear shaft sleeve 38 and against the front shaft sleeve 52 having a locking nut. The rotating rear shaft sleeve 38 is, when the parts of the pump proper 4 are assembled, situated inside the rear seal housing 36, and, likewise, the rotating front shaft sleeve 52 is situated within the front seal housing 50.

Sealing means are provided at the inner face of the shaft sleeves 38 and 50. In the most simple form such sealing means can be provided in the form of a sealing ring or sealing lip. Such sealing means can also be provided in the form of three spaced-apart lip sealing rings with two interposed support rings 112 as can be seen in the embodiment of the rotary displacement pump 2 in FIG. 5.

As can be seen in FIG. 1, both the rear seal housing 36 and the front seal housing 50 are of identical shape and size, and both are provided with slots, particularly circumferentially extending slots that allow for pressure compensation between the inside and the outside of the pump housing 24, that facilitate the cleaning and that allow for pumped material to enter in between the seal housings 36 and 50 and the shaft sleeves 38 and 52 and to and through the sea lings that are provided therebetween to an outside of the pump housing 24.

Furthermore, the shape and size of the rear shaft sleeve 38 and the front shaft sleeve 52 (with the exception of the locking nut) are identical in the embodiment of FIG. 1.

Thereby the parts variety will be reduced which allows for corresponding sealing arrangements in both the front and rear directions, as seen from the disk 42, which reduces the costs.

The scraper 44 has generally the configuration of a rectangular plate, but having an engagement slot into which the web of the disk 42 engages.

The scraper can be a unitary work piece, particularly made of polyamide.

Figure 3:
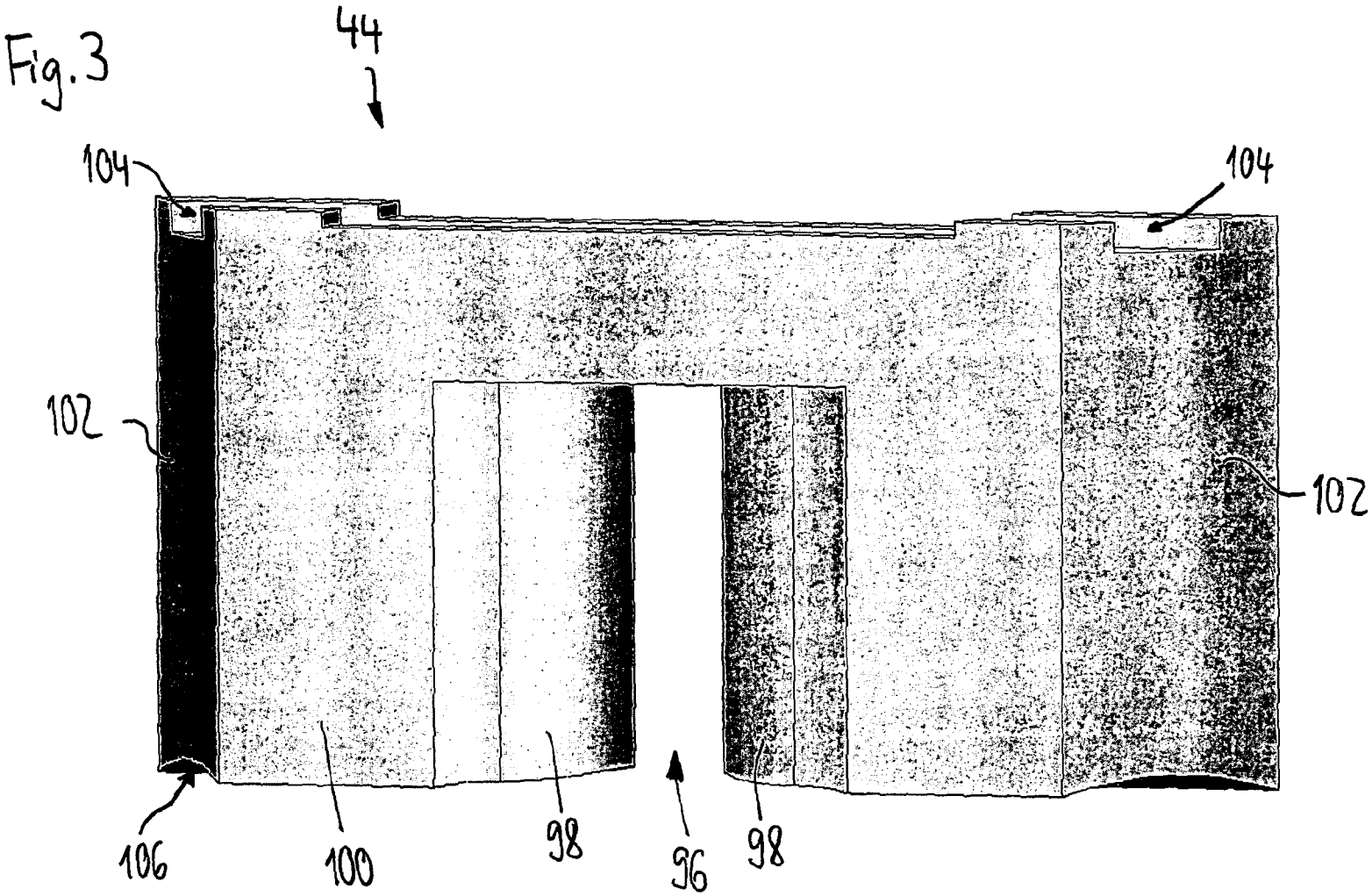
FIG. 3 shows a perspective view of the scraper element of the rotary displacement pump of FIG. 1, according to an embodiment of the invention.
Figure 4:
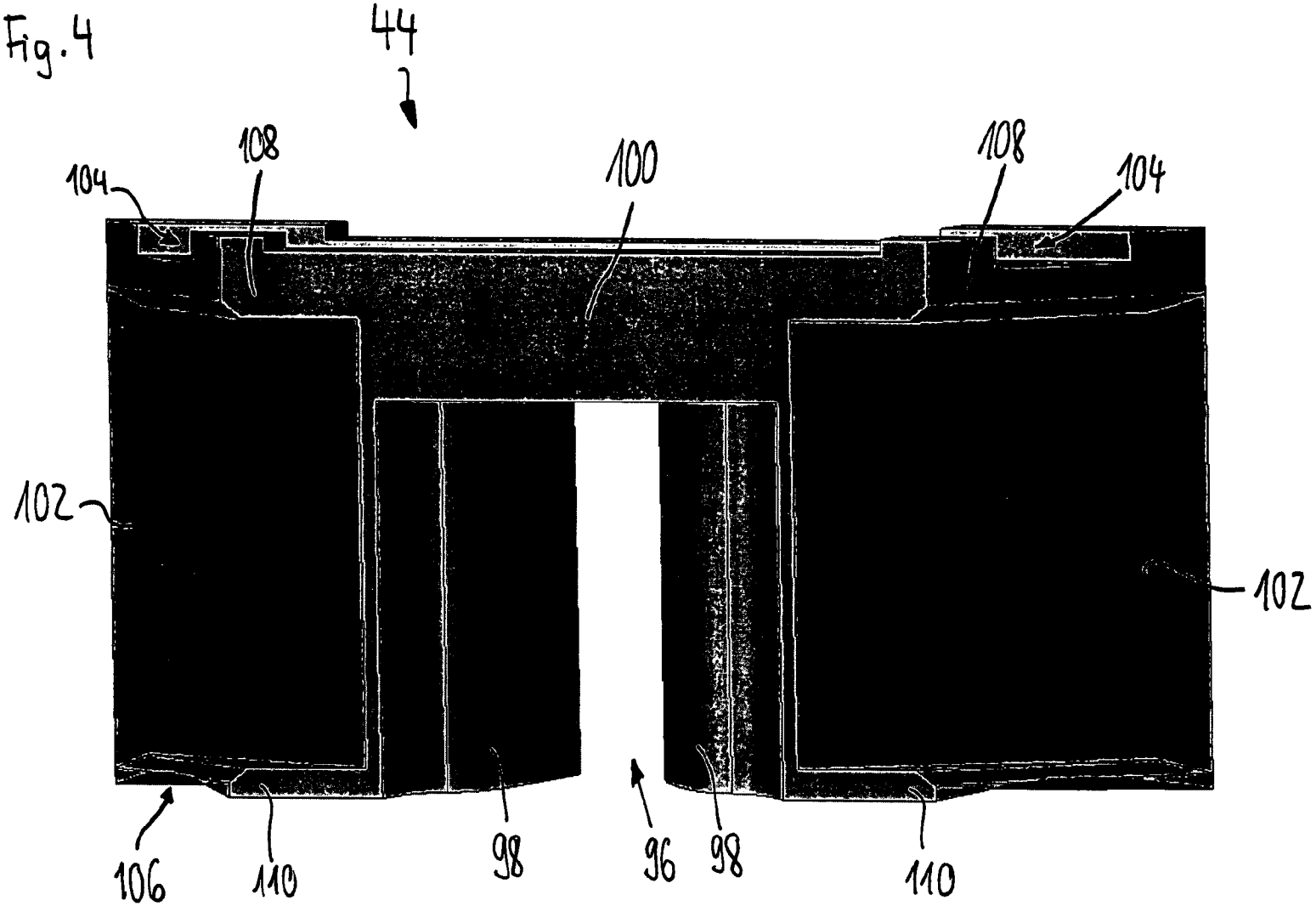
FIG. 4 shows a perspective view of the scraper element of the rotary displacement pump of FIG. 1, according to a further embodiment of the invention.

Referring now to FIGS. 3 and 4, curved transitions 98 are provided between the narrowest portion of the engagement slot 96 and the outlet chamber-facing surface 100 that can be seen in FIGS. 3 and 4 as well as the inlet chamber-facing surface that can be seen in FIG. 1.

The axial dimension of the engagement slot 96 at its smallest portion is just a little wider than the axial dimension of the web of the disk 42, so that the engagement slot 96 can be placed over the web, the scraper 44 straddling the web. The curved transitions 98 take into account the curved or undulatory configuration of the web as contrasted to a plane configuration.

The scraper 44 according to the embodiment of FIG. 3 as well as the scraper 44 according to the embodiment of FIG. 4 have a reduced width, as seen in the axial dimension in FIG. 1 from its front side end 102 (left-hand side in FIGS. 3 and 4) to its rear side end 102 (right-hand side in FIGS. 3 and 4). In the embodiment of FIGS. 3 and 4 the width of the scraper 44 corresponds to 68 to 72%, particularly 71% of the distance between the inner faces of the front end plate 56 to the rear end plate.

The scrapers 44 of the embodiment of both FIGS. 3 and 4 have an upper guiding groove 104 extending in an axial direction along the radially outer surface, this upper guiding groove 104 is extending between left and right upper guiding walls having a higher height in the lateral side portions and a reduced height in the middle portion. A corresponding guiding rail of the scraper guide 46 (not shown) engages into the upper guiding groove 104.

Likewise, the scrapers 44 of the embodiments of both FIGS. 3 and 4 have a lower guiding groove 106 of a rounded convex shape, this lower guiding groove 106 engaging with a corresponding circumferential portion of the seal housings 36 and 50.

By the guiding grooves 104 and 106 of the scraper 44 and by the corresponding guiding rail of the scraper guide 46 (not shown) and the corresponding circumferential portions of the seal housing elements 36 and 50, the scraper 44 is retained in the circumferential direction and a reciprocating movement in a substantially axial direction is made possible.

Furthermore, limit stops defining the extreme axial positions of the scraper 44 can be provided, particularly at the scraper guide 46. Moreover, the scraper guide 46 having in the embodiment of FIG. 1 the form of the partial cartridge has an outlet chamber oriented-surface against which the inlet chamber oriented larger surface of the scraper 44 butts and thus secures, in addition, the scraper 44 against a movement in circumferential direction.

The lateral side faces 102 of the scraper 44 in both embodiments of FIGS. 3 and 4 are oblique with respect to an axial plane, wherein the angle to an axial plane is in the range of 20 to 60 degrees, in the embodiment of FIG. 3 it is 50 degrees and in the embodiment of FIG. 4 it is 35 degrees.

In the scraper 44 of FIG. 3, the oblique side faces 102 form a plane extending over the whole radial height of the scraper 44, wherein in the scraper 44 of FIG. 4 the side faces 102 are surrounded in a radially outward direction by upper side face walls 108 and in a radially inward direction by lower side face walls 110.

By the reduced width of the scraper 44 and by the oblique side faces 102, the effect of packing material into corner areas of the outlet chamber, particularly between the side faces 102 and the inner faces of the front and rear end plates is significantly reduced, which contributes to a good material flow and thus an efficient and reliable operation of the pump.

The scraper guide 46 is firmly mounted in the pump housing 24, in particular between the front end plate 56 and the rear end plate.

Referring again to FIG. 2, a substantially cylindrical supporting cavity 94 is formed in the upper portion of the inner side of the front end plate 56 above the central opening 92, this supporting cavity 94 supports and secures the scraper guide 46 when the parts of the pump proper 4 are assembled. Likewise a supporting cavity can be provided in the rear end plate (shown in FIG. 5).

Referring again to FIG. 1, between the front face of the support part housing 10/mounting frame 12 and the rear end plate of the pump housing 24 there is provided, from back to front, a shaft sleeve 16, a rear security ring 18, a retainer ring 20 and a spacer ring 22 with lateral evacuation apertures.

Figure 5:
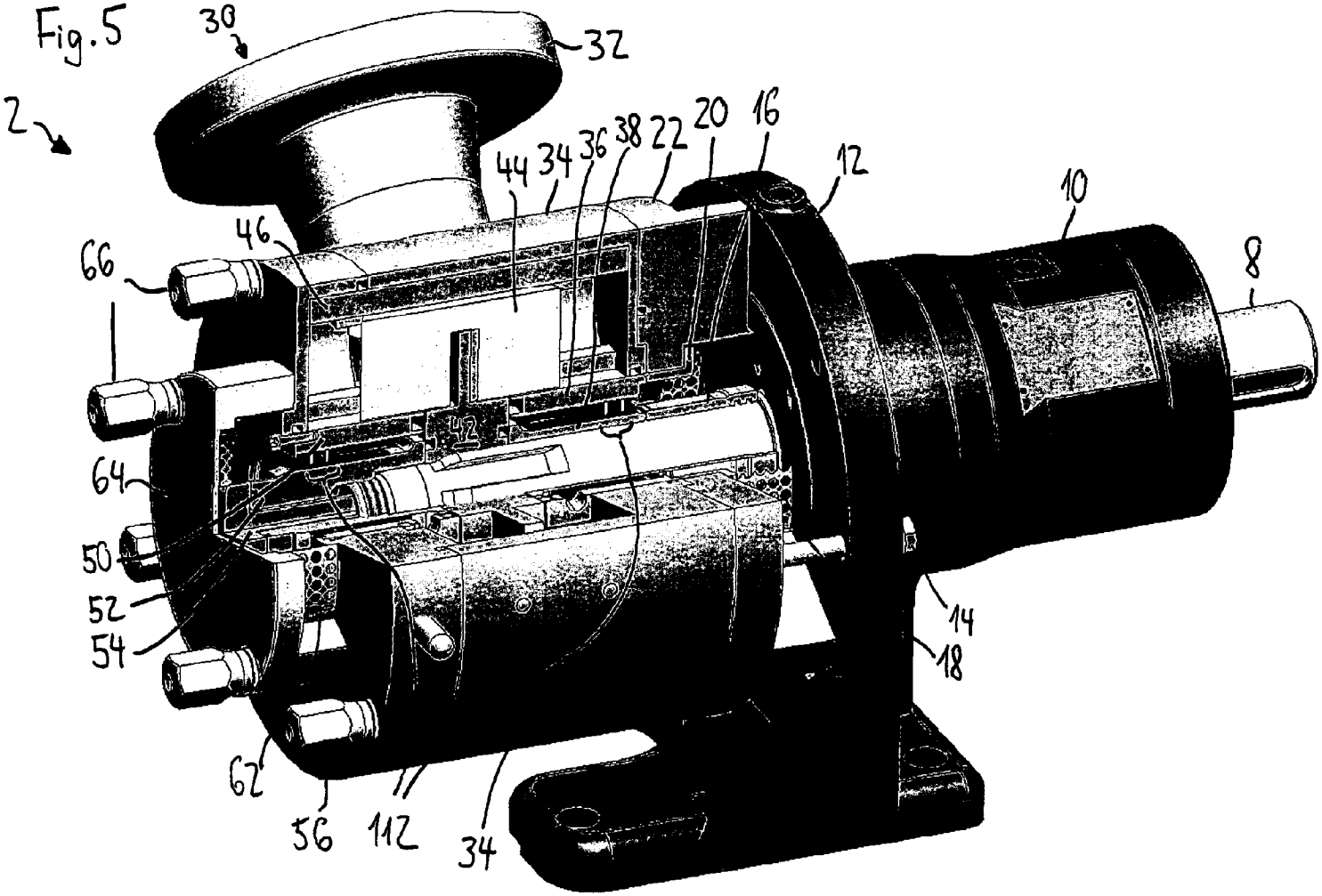
FIG. 5 shows a perspective view of the rotary displacement pump of FIG. 1 in its mounted state with an upper left quadrant part being cut off.

In the mounted state of the pump 2 that can be seen in FIG. 5 material coming out of the pump housing 24 in a rearward direction, particularly through the sealing between the rear seal housing 36 and the rear shaft sleeve 38 can run out of these lateral evacuation apertures, wherein at the same time the grating-like rear security ring 18 prevents users from unintentionally touching the rotating shaft 8/shaft sleeve 16.

In FIG. 5 it can further be seen that the shaft sleeves 16 and 20 attach to each other, both of them are firmly secured to the shaft 8.

Further, the locking screw 54 extends through the front shaft sleeve 52 with the locking nut and is fixed in the central opening of the shaft 8 by means of threads (not shown) provided at the locking screw 54 and the central opening of the shaft 8. By this configuration, the front shaft sleeve 52, the disk 42, the rear shaft sleeve 38 and the further shaft sleeve 16 are fixed firmly to the shaft 8 such that they rotate together with the shaft 8.

As can further be seen in FIG. 5, the front end of the shaft configuration, i.e. the front end of the front shaft sleeve 52 with the locking nut and the locking screw 54, protrudes out of the central opening in the front end plate 56. Material coming out of the pump housing 24 in a forward direction, particularly between the rotating front shaft sleeve 52 and the stationary front seal housing 50 and the sealing 112 provided therebetween can leave the pump 2 through the radial evacuation apertures in a security cover 64 that is placed before the central opening of the front end plate 56 and the front shaft sleeve 52 as well as the locking screw 54 protruding out of that central opening. The diameter of the security cover 64 is somewhat smaller than the diameter of the front end plate 56.

As with the radial evacuation apertures in the spacer ring 22 the radial evacuation apertures in the security cover 64 are closed from unintentional access by a user in a radial direction by means of a security grating ring 62. The front security ring 62 corresponds in shape and size to the rear security ring 18 which further helps to reduce the number of parts involved and thus to reduce costs.

Furthermore, mounting pins 58 and front cover nuts 66 are provided in order to firmly and safely fix the security cover 64 to the front end plate 56 and the front end plate 56 to the tubular cylindrical body 34.

In FIG. 5 the rear end plate 57 that is formed integral with the tubular cylindrical body 34 can well be seen. Furthermore, it can be seen that the web of the disk 42 engages with the engagement slot of the scraper 44. In the sectional cut of the upper left quadrant of FIG. 5 the portions of the parts lying in this quadrant and in particular the inlet port 26 and the inlet port flange 28 are omitted. Not visible in FIG. 5 are the front and rear stator elements 40 and 48.

In FIG. 5, the left-hand side of the cartridge-like scraper guide 46 is omitted and thus the inlet chamber facing-surface of the scraper 44 and part of the outlet chamber can be seen in axial direction before and behind the scraper 44.

Furthermore, the dimension of the outlet chamber in the axial direction can be seen, from the front bottom (in axial direction) of the supporting cavity in the front end plate 56 to the rear bottom (in axial direction) of the supporting cavity in the rear end plate 57 of the tubular cylindrical body 34.

By the rotary displacement pump 2 as described with respect to FIGS. 1 to 5, which consist of a relatively small number of parts making it cheap and easy to manufacture, solids emulsions of any kind and particularly liquid explosives can be pumped efficiently and safely.

List of Reference Numerals

2 rotary displacement pump
4 pump part
6 support part
8 shaft
10 support part housing
12 mounting frame
14 mounting pins
16 shaft sleeve
18 rear security ring
20 retainer ring
22 spacer ring
24 pump housing
26 inlet port
28 inlet port flange
30 outlet port

32 outlet port flange
34 tubular cylindrical body
36 rear seal housing
38 rear shaft sleeve
40 rear stator/liner element
42 rotor
44 scraper element
46 scraper guide
48 front stator/liner element
50 front seal housing
52 front shaft sleeve with locking nut
54 locking screw
56 front end plate
57 rear end plate
58 mounting pins
60 screws
62 security grating ring
64 security cover
66 front cover nuts
68 circumferential wall
70 radial wall
72 outer face
74 lateral abutment face
76 stator channel bottom face
78 lateral stator channel face
80 inlet chamber bottom
82 oblique transition portion of outlet chamber
84 straight outlet chamber bottom
86 circumferential mounting portion
88 apertures
90 ring-formed inner face
92 central opening
94 supporting cavity
96 engagement slot
98 curved transitions
100 outlet chamber-facing front
102 oblique side faces
104 upper guiding groove
106 lower guiding groove
108 upper side face walls
110 lower side face walls
112 lip sealing rings

The invention claimed is:

1. A rotary displacement pump (2) for pumping solids emulsions, especially liquid explosives, said rotary displacement pump comprising:

a stator (40, 48);

a rotor (42) configured to be driven by a shaft (8), said rotor (42) including a shaft portion and a radially protruding web having a configuration of an undulatory disk type;

a scraper (44) having an engagement slot (96) of predetermined radial height and predetermined axial width, said engagement slot (96) engaging said protruding web of said rotor (42);

said scraper (44) being supported by a scraper guide (46) so as to be retained in circumferential direction and to allow a reciprocating movement in a substantially axial direction;

a pump housing (24) comprising a front end plate (56) with an inner face and a rear end plate (57) with an inner face, said pump housing (24) enclosing said stator (40, 48), said rotor (42), said scraper (44) and said scraper guide (46);

said stator (40, 48) including a generally semi-circular arc-formed first stator member (40) and a generally semi-circular arc-formed second stator member (48), said first and second stator members (40, 48) having upper end faces (80, 82, 84) abutting to each other laterally along a radially outer abutment portion (74) so as to form a stator channel through which said radially protruding web of said rotor (40, 48) runs and to define an enclosure (68, 70) that encircles a generally semi-circular arc-formed portion of said radially protruding web of said rotor (42);

said stator (40, 48), said pump housing (24) and said scraper (44) together with said scraper guide (46) defining an inlet chamber and an outlet chamber, said scraper (44) together with said scraper guide (46) forming a partition between said inlet chamber and said outlet chamber, said inlet and outlet chambers being provided with respective inlet and outlet ports (26, 30);

said stator channel extending from said inlet chamber to said outlet chamber, said web of said rotor (42) being rotatable through said inlet chamber, said stator channel, said outlet chamber and said slot (96) of said scraper (44), wherein at least part of said end faces of said first and second stator members (40, 48) being situated in said outlet chamber are oblique, said end faces of said first and second stator members (40, 48) in said outlet chamber providing an obtuse-angled transition to said inner faces of said front end plate (56) and said rear end plate (57), wherein said shaft (8) extends through both said front and rear end plates (56, 57), and wherein generally tube-shaped front and rear seal housing elements (36, 50) are positioned in the central recesses of said first and second stator members (40,48); and wherein front and rear shaft sleeves (38, 52) attach to said rotor (42), wherein said front and rear shaft sleeves (38, 52) are situated within said seal housing elements (36, 50), and wherein sealing elements are provided between said rotating front and rear shaft sleeves (38, 52) and said stationary seal housing elements (36, 50).

2. The pump of claim 1, wherein the obtuse angle between said end faces of said first and second stator members (40, 48) and said inner faces of said front end plate (56) and said rear end plate (57) is 120 to 160°.

3. The pump of claim 1, wherein said seal housing elements (36, 50) confine said inlet and outlet chambers in the direction towards said shaft (8).

4. The pump of claim 3, wherein said seal housing elements (36, 50) are provided with at least one slot to relieve material build up.

5. The pump of claim 1, wherein said sealing elements are provided at the inner side of said seal housing elements (36, 50).

6. The pump of claim 1, wherein said sealing elements are formed as three lip sealing rings with two interposed support rings.

7. The pump of claim 1, wherein said generally tube-shaped front seal housing element (36) and said generally tube-shaped rear seal housing element (50) are of identical shape and size.

8. The pump of claim 1, wherein the tip of said shaft (8) or said front shaft sleeve (52) and/or a front locking element (54) securing said front shaft sleeve (52) to said shaft (8) protrudes out of said front end plate (56).

9. The pump of claim 8, wherein a security cover element (64) is provided covering the tip of said shaft (8) or said front shaft sleeve (52) and/or said front locking element (54), said security cover element (64) having evacuation apertures in order to allow for the solids emulsion passing through.

10. The pump of claim 1, wherein behind said rear end plate (57) there is provided a recessed spacer element (22) having evacuation apertures in order to allow for the solids emulsion passing through.

11. The pump of claim 9, wherein said apertures are closed by means of grating elements (18, 62).

12. The pump of claim 1, wherein said scraper (44) has the general form of a plate with said engagement slot (96) formed therein, wherein the width of said scraper (44) corresponds to 65 to 75% of the width of said inlet and outlet chambers, measured from said front end plate (56) to said rear end plate (57) of said pump housing (24), so as to provide, in the extreme axial positions of said scraper (44), for sufficient distance between the side faces of said scraper (44) and said front and rear end plates (56, 57) of said pump housing (24).

13. The pump of claim 1, wherein said scraper (44) has the general form of a plate with said engagement slot (96) formed therein, wherein the side faces of said scraper (44) are oblique with respect to an axial plane with the face of said scraper (44) being oriented towards said outlet chamber having a smaller surface area than the face of said scraper (44) being oriented towards said inlet chamber, thereby reducing the effect of packing solids emulsions into corner areas of said outlet chamber, said corner areas particularly being situated between said side faces of said scraper (44) and the portions of said front and rear end plates (56, 57) facing said side faces of said scraper (44).

14. The pump of claim 13, wherein the angle between said side faces of said scraper (44) and said axial plane is 20 to 60°.

15. The pump of claim 1, wherein said scraper guide (46) has the form of a recessed plate or cartridge, the width of the recess being such that said engagement slot (96) of the scraper (44) in its extreme axial positions lies within said recess.

16. The pump of claim 1, wherein said scraper guide (46) has limit stops defining the extreme axial positions of said scraper (44).

17. The pump of claim 1, wherein said scraper guide (46) is supported within said pump housing (24) between said front and rear end plates (56, 57).

18. The pump of claim 17, wherein at least one of said front and rear end plates (56, 57) comprises a mating cavity (94) supporting said scraper guide (46).

19. The pump of claim 1, wherein said scraper (44) has a radially outer guiding groove (104) engaging with a corresponding guiding track of said scraper guide (46) and a radially inner guiding groove (106) engaging with corresponding circumferential portions of said seal housing elements (36, 50), thereby retaining said scraper (44) in circumferential direction and allowing a reciprocating movement in a substantially axial direction.

20. The pump of claim 1, wherein the material of the scraper (44) has a melting temperature below the critical temperature of the pumped solids emulsion.

21. Use of the pump as defined in claim 1 for pumping solids emulsions, especially for pumping liquid explosives.

* * * * *